US007959099B1

(12) United States Patent
Cox et al.

(10) Patent No.: US 7,959,099 B1
(45) Date of Patent: Jun. 14, 2011

(54) BOLT-IN TOOLHOLDER FOR A ROTOR ASSEMBLY

(76) Inventors: William W. Cox, Louisville, KY (US); George R. Sotsky, Louisville, KY (US)

( * ) Notice: Subject to any disclaimer, the term of this patent is extended or adjusted under 35 U.S.C. 154(b) by 93 days.

(21) Appl. No.: 12/488,166

(22) Filed: Jun. 19, 2009

(51) Int. Cl.
*B02C 18/06* (2006.01)

(52) U.S. Cl. ..... 241/294

(58) Field of Classification Search ..... 241/294, 241/242, 243
See application file for complete search history.

(56) References Cited

U.S. PATENT DOCUMENTS

| | | | | |
|---|---|---|---|---|
| 2,660,242 | A | 11/1953 | Lane | |
| 3,662,444 | A | 5/1972 | Erkfritz | |
| 3,694,876 | A | 10/1972 | Erkfritz | |
| 3,716,900 | A | 2/1973 | Erkfritz | |
| 4,247,232 | A | 1/1981 | McCreery et al. | |
| 4,507,024 | A | 3/1985 | Stashko | |
| 4,785,860 | A | 11/1988 | Arasmith | |
| 5,192,171 | A | 3/1993 | Ther et al. | |
| 5,199,827 | A | 4/1993 | Pantzar | |
| 5,207,748 | A | 5/1993 | Katbi et al. | |
| D340,464 | S | 10/1993 | Markusson et al. | |
| D367,866 | S | 3/1996 | Pantzar et al. | |
| D369,362 | S | 4/1996 | Pantzar et al. | |
| 5,544,984 | A | 8/1996 | Pantzar | |
| 5,653,274 | A | 8/1997 | Johnson et al. | |
| D409,633 | S | 5/1999 | Bernadic et al. | |
| 6,035,844 | A | 3/2000 | Otani et al. | |
| 6,158,928 | A | 12/2000 | Hecht | |
| 6,176,445 | B1 | 1/2001 | Shinn | |
| 6,234,724 | B1 | 5/2001 | Satran et al. | |
| 6,305,623 | B1 | 10/2001 | Sotsky et al. | |
| 6,422,495 | B1 | 7/2002 | De Boef et al. | |
| 6,523,768 | B2 | 2/2003 | Recker et al. | |
| 6,640,853 | B1 * | 11/2003 | Sun | 144/218 |
| 6,698,477 | B1 * | 3/2004 | Bennington | 144/235 |
| 6,837,453 | B2 | 1/2005 | Sturm | |
| 6,848,640 | B2 | 2/2005 | Pallmann | |
| 6,880,774 | B2 | 4/2005 | Bardos et al. | |
| 6,983,904 | B2 * | 1/2006 | Plahuta et al. | 241/242 |
| 7,055,770 | B2 | 6/2006 | Bardos | |
| 7,100,855 | B2 * | 9/2006 | Diemunsch | 241/236 |
| 7,213,779 | B2 | 5/2007 | Roozeboom et al. | |
| D555,684 | S | 11/2007 | Waggle et al. | |
| 7,293,729 | B2 | 11/2007 | Ragnarsson | |
| 7,390,151 | B2 | 6/2008 | Martin et al. | |
| 2003/0061926 | A1 | 4/2003 | Sotsky | |
| 2006/0102762 | A1 * | 5/2006 | Garcia et al. | 241/294 |
| 2009/0008491 | A1 * | 1/2009 | Sharp | 241/294 |

FOREIGN PATENT DOCUMENTS

DE 4005647 A1 8/1990

* cited by examiner

*Primary Examiner* — Faye Francis
(74) *Attorney, Agent, or Firm* — Middleton Reutlinger; James E. Cole

(57) ABSTRACT

A bolt-in toolholder assembly for a shredding device includes a rotor having a substantially cylindrical shape, a plurality of pockets formed in the rotor and spaced apart preselected distances to form preselected patterns, a bolt-in toolholder.

25 Claims, 17 Drawing Sheets

BOLT-IN TOOLHOLDER FOR A ROTOR ASSEMBLY

CROSS-REFERENCE TO RELATED DOCUMENTS

None

TECHNICAL FIELD

This invention pertains to a shredder rotor assembly. More specifically, the invention pertains to a shredder rotor assembly having bolt-in toolholder assemblies connecting the cutting tools to the toolholders and the toolholders to the rotor.

BACKGROUND

Various types of shredding devices are known in the art. Rotor devices often utilize welded toolholders and bolted cutting tools as part of the rotor assemblies. However, welded toolholders are prone to breaking from the rotor after periods of use. The welded toolholders are difficult to replace without removal of the rotor from the shredding implement.

Given the forgoing problems with the current art of rotor devices, toolholders are desirable which are durable, easily replaceable and may be retrofit to existing rotor systems.

SUMMARY

A bolt-in toolholder assembly for a shredding device, comprises a rotor having a substantially cylindrical shape, a plurality of pockets formed in the rotor and spaced apart preselected distances to form preselected patterns, a toolholder shaped to fit and be seated within the at least one of the plurality of pockets, the toolholder comprising a base portion and a cutter mounting surface, the base having a first fastening aperture and receiving a first bolt for bolting the toolholder to the rotor, the cutter mounting surface having a second fastening aperture and receiving a second bolt for bolting the toolholder to the rotor, the first and second fastening apertures being circumferentially aligned, a third fastening aperture extending substantially transverse to the second fastening aperture and receiving a third bolt across the second fastening aperture and through the cutter mounting surface and, a cutting tool disposed against the cutter mounting surface where the cutter mounting surface extends upwardly from the base, the third bolt connecting the cutting tool to the cutter mounting surface. The bolt-in toolholder assembly further comprising one of a radius and a chamfer between the base and the cutter mounting surface. The bolt-in toolholder assembly further comprising an insert between the cutter mounting surface and the cutting tool. The bolt-in toolholder assembly wherein the insert has one of a radiused or chamfered edge substantially corresponding to the radius or chamfer between the base and the cutter mounting surface. The bolt-in toolholder assembly wherein the third bolt extends from the rear of the toolholder through the cutter mounting surface. The bolt-in toolholder assembly further comprising a machined portion in a rear surface of the toolholder for receiving a bolt head. The bolt-in toolholder assembly wherein the rotor has a substantially flat surface. The bolt-in toolholder assembly wherein the cutting tool is trapezoidal in shape. The bolt-in toolholder assembly wherein the cutting tool is substantially square in shape. The bolt-in toolholder assembly wherein the rotor has a substantially corrugated surface. The bolt-in toolholder assembly wherein the cutting tool is substantially square and has a corner extending into the corrugated surface.

The bolt-in toolholder assembly further comprising at least one cap for covering at least one of the fastening apertures. The bolt-in toolholder assembly wherein the preselected pattern is chevron shaped. The bolt-in toolholder assembly wherein the preselected pattern being spiral shaped.

A bolt-in toolholder assembly for a shredding device comprises a rotor having a substantially cylindrical shape, a plurality of toolholders bolted to the rotor in a preselected pattern and spacing, a plurality of pockets disposed along the rotor, the plurality of toolholders disposed in the plurality of pockets, each of the plurality toolholders having a base and a tool mounting portion, each of the plurality of toolholders having a first bolt extending through the base and a second bolt extending through the tool mounting portion, first and second bolt holes receiving bolts generally extending radially into the rotor, a third bolt hole extending through the tool mounting portion and intersecting the second bolt hole, a cutting tool positioned on the tool mounting portion, the cutting tool having an aperture aligned with the third bolt hole and, a third bolt extending through the tool mounting portion and engaging the cutting tool. The bolt-in toolholder assembly wherein the preselected pattern is one of spiral or chevron shaped. The bolt-in toolholder assembly further comprises an insert disposed between the cutting tool and the tool mounting portion of the toolholder. The bolt-in toolholder assembly wherein the first and second bolts are aligned circumferentially to narrow a width of each of the plurality of toolholders. The bolt-in toolholder assembly wherein the width of each of the plurality of toolholders is less than a width of the cutting tool. The bolt-in toolholder assembly wherein the rotor is one of a substantially smooth surface and a corrugated surface. The bolt-in toolholder assembly wherein the cutting tool has one of a smooth surface corresponding to said smooth surface of said rotor and a corner extending into said corrugated surface. The bolt-in toolholder assembly wherein the third bolt extends in a direction of rotor rotation. The bolt-in toolholder assembly further comprising caps for the first and second bolt holes.

A bolt-in toolholder assembly for shredding comprises a rotor having a generally cylindrical shape, a plurality of pockets disposed along a periphery of the rotor in a preselected pattern, at least one of the pockets having a toolholder including a base disposed within the pocket and a cutting tool portion extending above an upper surface of the rotor, a first bolt hole extending through the base and aligned with a fastener aperture in the rotor, a second bolt hold extending through the cutting tool portion and circumferentially aligned with a second fastener aperture in the rotor, a third bolt passing through the third bolt hole and engaging the cutting tool and, a cutting tool fastened to the toolholder. The bolt-in toolholder wherein at least one of the plurality of pockets has a cap covering the pocket.

BRIEF DESCRIPTION OF THE ILLUSTRATIONS

Embodiments of the invention are illustrated in the following illustrations.

DETAILED DESCRIPTION

Figure 1:
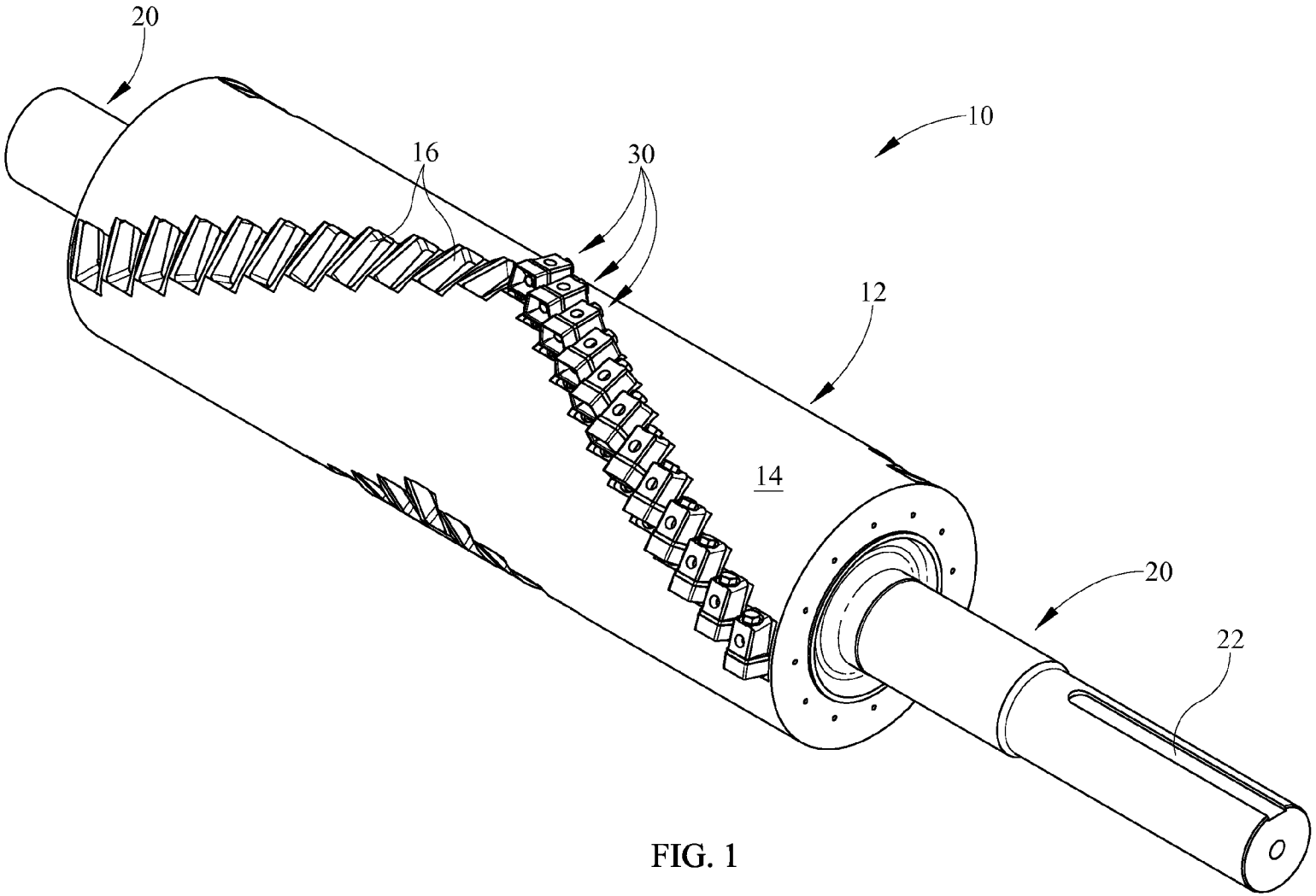
FIG. 1 depicts a perspective view of a rotor assembly having bolt-in toolholders.

Referring initially to FIG. 1, a shredder rotor assembly 10 is depicted in perspective view. The rotor assembly 10 comprises a rotor 12 having a substantially cylindrical shape and a substantially smooth outer surface 14 although the smooth surface is exemplary as will be understood upon further view of this disclosure. Positioned along the surface 14 are a plurality of pockets 16 which have a preselected shape. The pockets 16 are narrowly spaced together to allow for a closer spacing of cutting tools 34 (FIG. 4), as described further herein. The pockets 16 are also shown offset from one another circumferentially some preselected angular distance. The pockets 16 are offset, or indexed, an arcuate distance less than the arcuate length of pockets 16. However, the amount of index may vary as the instant embodiment is merely exemplary. For example, the index distance will differ for a chevron pocket arrangement and a spiral pocket arrangement. The pockets 16 are arranged in such a manner so that the cutting tools 34 do not all pass through the counter knife (not shown) as the same time which would induce an extremely large loading on the cutting tools 34, toolholders 32 and rotor 12, as well as the transmission and motor driving the shredder rotor assembly 10. According to the exemplary embodiment of FIG. 1, the pockets 16 are generally arranged in shape of a chevron, however, such arrangement is merely exemplary and alternative shapes and arrangements may be utilized and therefore are well within the scope of the present arrangements. The exemplary shape permits two cutting tools 34 to pass through the counter knife at a given instant. Extending from the rotor 12 at axial ends is a shaft 20. The shaft 20 may be integrally formed with the rotor 12, for example by machining, or may be fastened or welded to the rotor 12. The shaft 20 extends from first and second ends of the rotor 12. The shaft 20 additionally comprises a key way 22 located at one of the first end and the second end of the shaft 20. The key way 22 allows for torque transmission from a motor or a transmission (not shown) to a shaft 20 in order to rotate the rotor assembly 10, as will be understood by one skilled in the art.

Disposed within the pockets 16 are toolholder assemblies 30. According to the instant embodiment, the toolholder assemblies 30 are closely spaced to provide additional shredding capability and cut material into smaller particles. The toolholder assemblies 30 are each positioned in the pocket 16 and therefore, according to the exemplary embodiment, are closely spaced in the axial direction and circumferentially offset by a preselected angular distance, as previously described with respect to the pockets 16.

Figure 2:
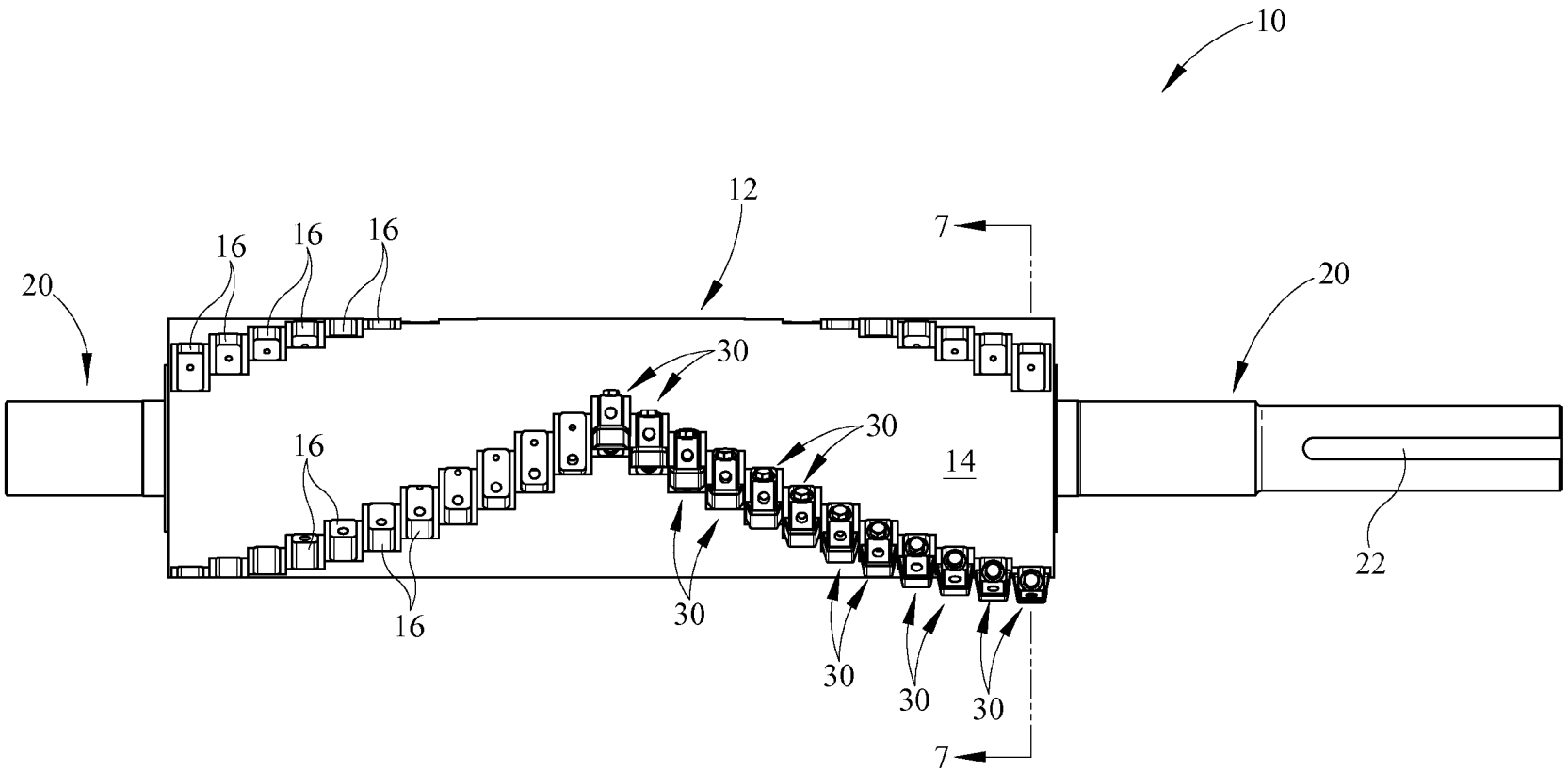
FIG. 2 depicts a front view of the rotor assembly of FIG. 1.

Referring to FIG. 2, the rotor assembly 10 is shown in a front view. The rotor assembly 10 is depicted rotated about the axis of the shaft 20 about ninety (90) degrees from the view of FIG. 1. The pockets 16 are shown both occupied and unoccupied by various toolholder assemblies 30 merely for illustration. The positioning of pockets 16 along the upper area of rotor surface 14 clearly show the circumferential offset or indexing which provides improved cutting or tearing capacity without requiring axial alignment of the toolholder assemblies 30.

The view of the toolholder assemblies 30 disposed on the rotor 12 shows the close spacing of the cutting tools 34 so that material being shredded may be cut into smaller particles. The narrow spacing of the toolholder assemblies 30 is possible due to the narrow shape of the toolholders 32. Thus, there is little to no space, in the instant embodiment, between adjacent cutting tools 34 and this is possible due to the narrow configuration of the toolholders 32.

Figure 3:
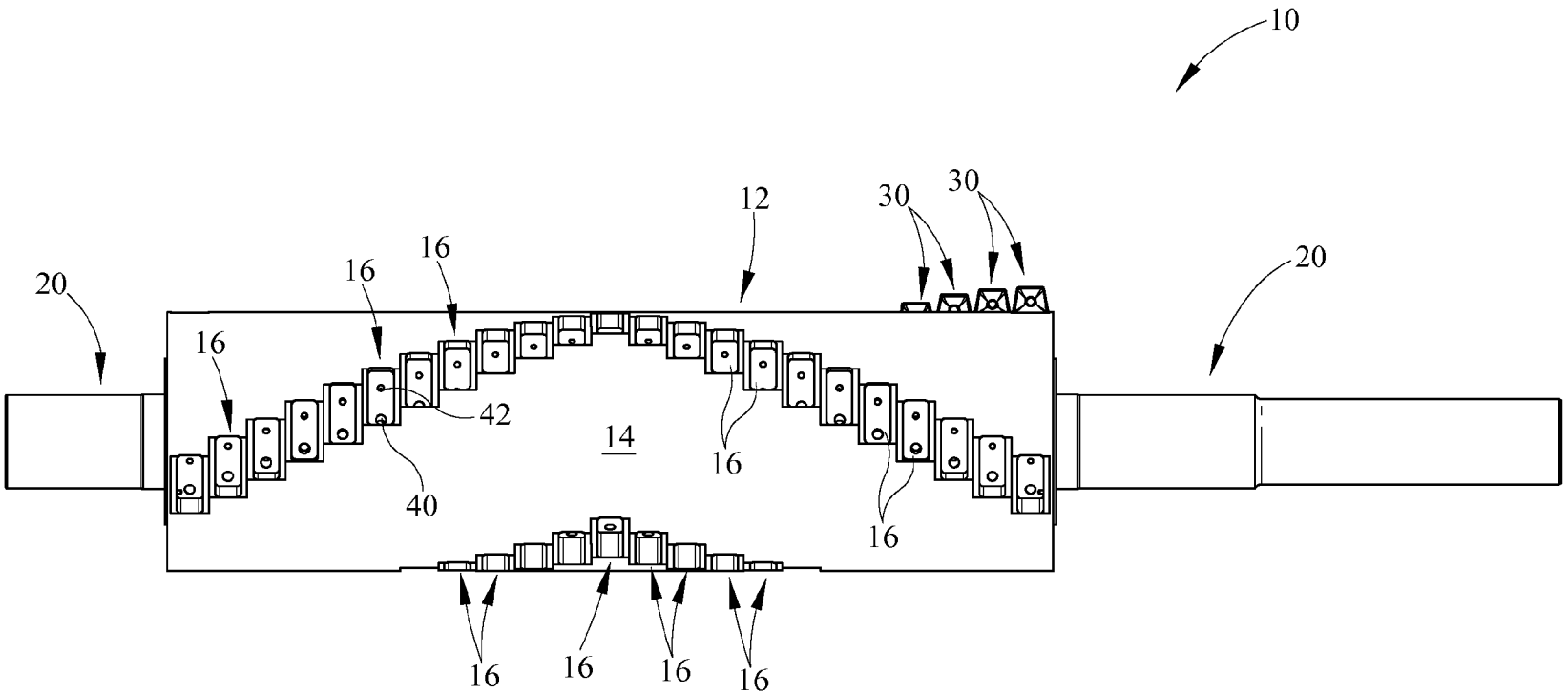
FIG. 3 depicts a front view of the rotor assembly of FIG. 1, rotated from the position shown in FIG. 2.

Referring to FIG. 3, the rotor 12 is rotated some arcuate distance from the position shown in FIG. 2. The assemblies 30 are removed from pockets 16 allowing viewing of the internal surfaces of each pocket 16. Each pocket 16 comprises a first fastening aperture 40 and a second fastening aperture 42. The first fastening aperture 40 is larger in diameter than the second fastening aperture 42. The first fastening aperture 40 is larger and receives a larger fastener in order to inhibit torque induced movement of the toolholder assembly 30 when the cutting tool 34 is acted upon by a force due to the shredding or cutting.

Figure 4:
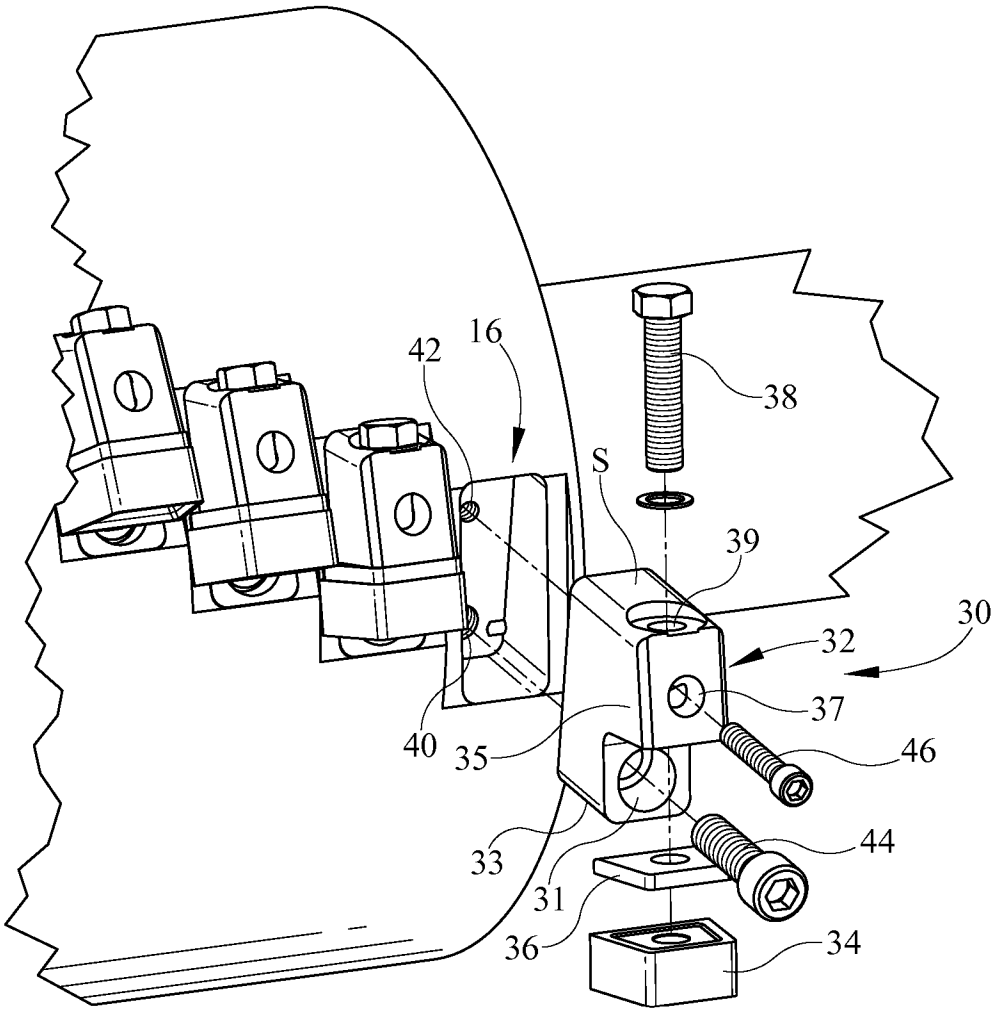
FIG. 4 depicts an exploded perspective view of the bolt-in toolholder.
Figure 5:
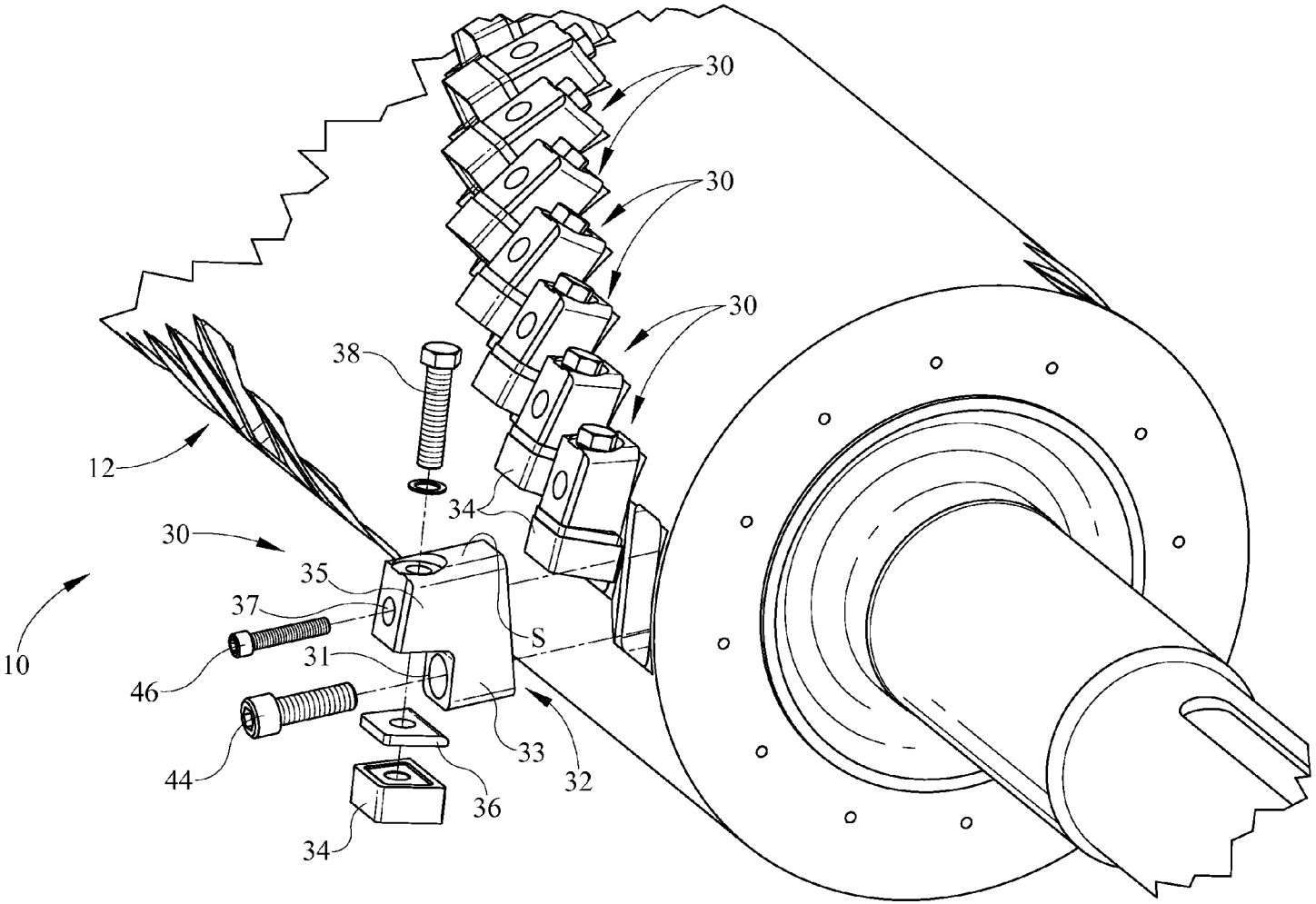
FIG. 5 depicts an alternative exploded perspective view of the bolt-in toolholder.

Referring now to FIGS. 4 and 5 exploded perspective views of the rotor assembly 10 and toolholder assemblies 30 are depicted. Specifically, FIGS. 4 and 5 each show one exploded toolholder assembly 30 removed from a pocket 16. Within the pocket 16, the first fastening aperture 40 and the second fastening aperture 42 are depicted in the lower most surface of the pocket. Exploded from the pocket 16, each toolholder assembly 30 comprises a toolholder 32, a cutting tool 34 and an insert 36. The assembly 30 further comprises a first fastener 44 and a second fastener 46. The first and second fasteners 44 and 46 are both depicted by bolts which extend through the toolholder 32 and into the rotor 12 creating a substantially radial tightening force. The first and second fasteners 44, 46 are both aligned in the circumferential direction about the rotor 12. Finally, the assembly 30 further comprises a third bolt 38 extending through the toolholder 32. The toolholder 32 comprises a base 33 and a cutter mounting portion 35 extending upwardly through the base 33. Extending downwardly through the base 33 is a first fastening aperture 31 which receives first bolt 44 and is axially aligned with the first fastening aperture 40 in the pocket 16. The first bolt or fastener 44 extends substantially radially toward the center axis of the rotor assembly 10 through the toolholder 32 and into the rotor 12.

Circumferentially aligned with the first fastening aperture 31 is a second fastening aperture 37. Second fastening aperture extends through the upper surface of the cutter mounting portion 35. This aperture 37 is aligned with the second fastening aperture 42 in the pocket 16, both of which receive the second fastener or bolt 46 there through. The circumferential alignment of the first and second bolts 44, 46 and first and second aperture 31, 37 of the toolholder 32 allows for a narrow base of the toolholder 32. This in turn allows for more cutting tools 34 to be positioned across a given axial length of rotor 12. Having a narrow toolholder 32 provides that the toolholder 32 has a width less than the width of the cutting tool 34. This also allows for minimal spacing between immediately adjacent cutting tools 34. As previously described, these additional cutting tools 34 allow for smaller pieces of material to be cut or shred by the rotor assembly 10.

The rear surface S of the toolholder 32 is a bearing surface and force acts though the cutting tool 34. The bearing surface passes this force to the rotor 12 through the adjacent rear pocket surface. As the toolholder 32 is forced against the rear surface of the pocket 16, the first bolt 44 counteracts the moment which is created. For this reason, the first fastener 44 is of a larger diameter than second fastener 46.

The toolholder 32 further comprises a third fastening aperture 39 extending through the cutter mounting portion 35 and intersecting the axis defined by the second aperture 37. The third bolt aperture 39 intersects the axis defined by the second aperture 33. When the third bolt 38 is inserted through the cutter mounting portion 35 the second bolt 46 must have already been positioned on the second aperture 33 and be fastened into the rotor 12. The rear surface of the toolholder 32 may have a radiused area for receiving the head of third bolt 38. Since the axis of the third aperture 39 intersects that of the second aperture 37, the second bolt 46 must be positioned through the toolholder 32 prior to insertion of the third bolt 38 because upon insertion of the third bolt 38, the second aperture 37 would be blocked from passage of the upper surface of the toolholder base 33.

Referring still to FIG. 5, the circumferential offset of the toolholder assemblies 30 are depicted. The arcuate distance offset between adjacent toolholder assemblies 30 are about eight (8) degrees as measured from the cutting edge of one cutting tool 34 to an adjacent tool 34 on an adjacent toolholder assembly 30. However, this number should not be considered limiting as various arcuate offset angles, and therefore distances, may be utilized. According to this embodiment, the arcuate distance of the offset is less than the arcuate length of an assembly 30.

Exploded from the toolholder 32 is an insert 36. The insert 36 may be formed of a polymeric or elastomeric material which cushioned the cutting tool 34 against the cutter mounting portion 35. According to the exemplary embodiment, insert 36 may alternatively be formed of metal or other hardened material which still has a cushioning effect between the cutting tool 34 and the toolholder 34. The material used for the insert 36 may be formed of a metal which is softer than the tool 34 and the toolholder 32 in order to aid cushioning. The lower edge of the insert 36 is radiused or chamfered to match a corresponding radius or chamfer between upwardly facing the surface of the base 33 having the first fastening aperture 31 and the upwardly extending surface of the cutter mounting portion 35. The radius or chamfer is disposed between the two adjacent surfaces in order to strengthen the toolholder 32. The insert 36, therefore, clears the radiused area of the toolholder 32 providing a better fit for the cutting tool 34, eliminating the need to chamfer or radius the cutting tool 34 as well as providing the aforementioned cushioning between the cutting tool 34 and the cutter mounting portion 35.

Figure 6:
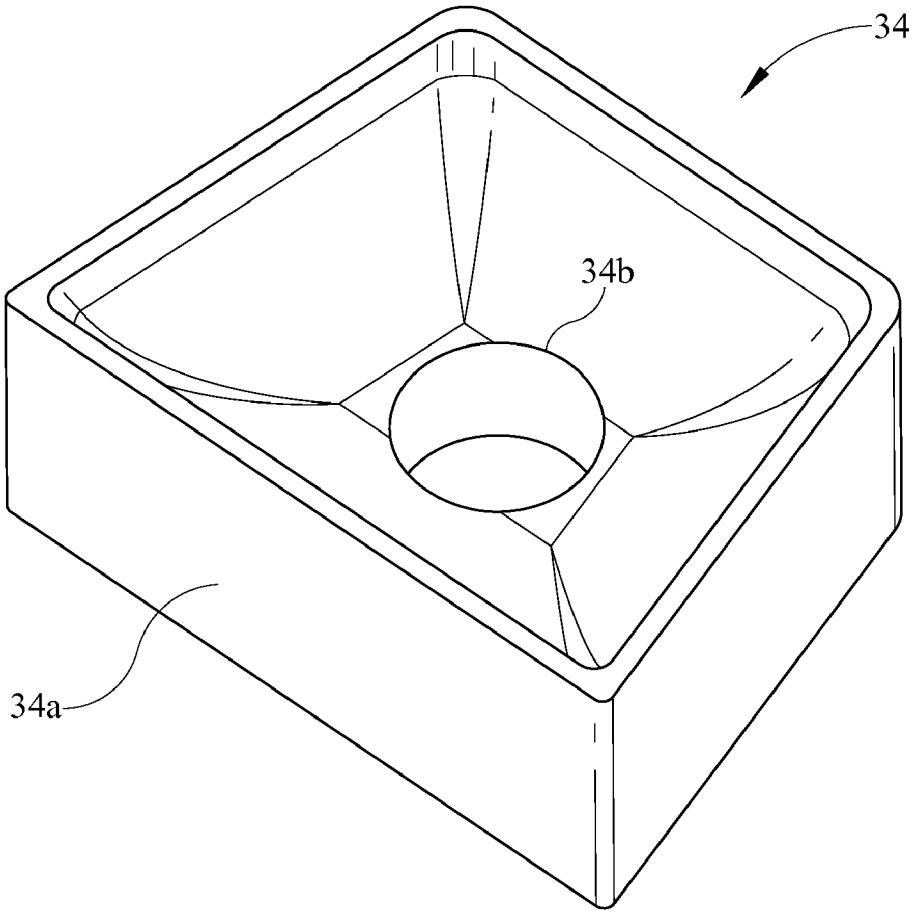
FIG. 6 depicts a perspective view of a cutting tool.

Referring now to FIG. 6, the cutting tool 34 is depicted in perspective view. The cutting tool 34 is generally trapezoidal in shape and has a curvilinear interior surface extending from the outer edge of the cutting tool 34 to an inner aperture **34*b* which receives the fasteners 39. The cutting tool 34 of the instant embodiment is merely exemplary and alternative shapes may be utilized. The lower surface 34*a* of the cutting tool 34 is generally flat and sits flush against the upwardly facing surface having aperture 31 in the toolholder 32**.

Figure 7:
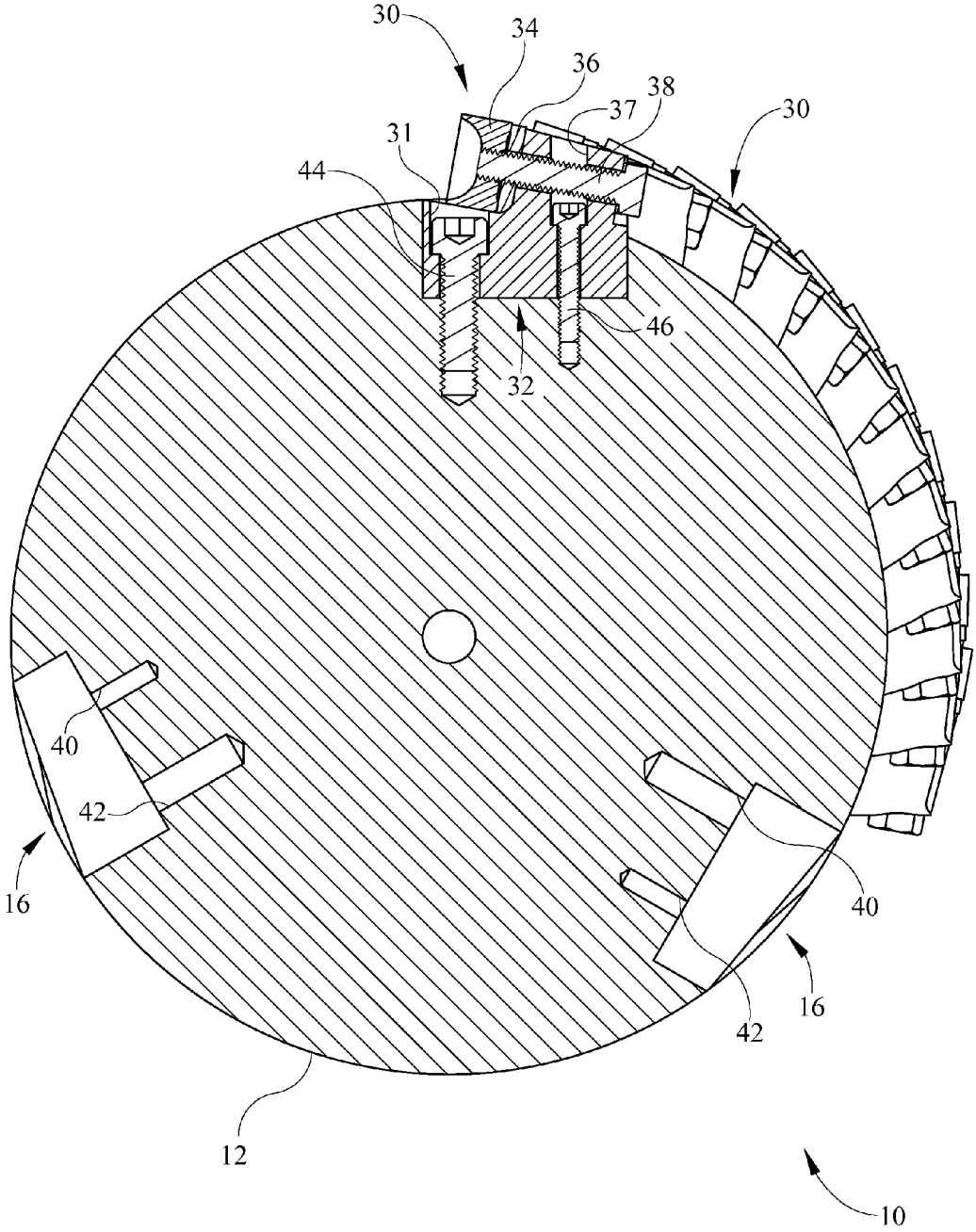
FIG. 7 depicts a side section view of the rotor assembly of FIG. 1.

Referring now to FIG. 7, a side section view of the rotor assembly 10 is depicted. Two empty pockets 16 are depicted including the first and second fastening apertures 40, 42. A third pocket 16 is shown having a toolholder 32 therein. The toolholder 32 includes the first fastener 44 extending into the rotor 12 and the second fastener 46. As previously described, the first and second fasteners 44, 46 are circumferentially aligned which allows the toolholder 32 to have a narrow width. Above the first and second fasteners and extending through the cutter mounting portion of the toolholder 32 is a third fastener 38. The third fastener 38 intersects the passage or aperture 37 for the second fastener 46. The third fastener 38 also extends through the cutter mounting portion to fasten the cutter 34 and insert 36 to the toolholder 32. The cutter 34 is positioned above the first fastener 44. Caps may be utilized to cover the fastening apertures 37, 31 in order to limit the amount of cut material which falls into those apertures.

Figure 8:
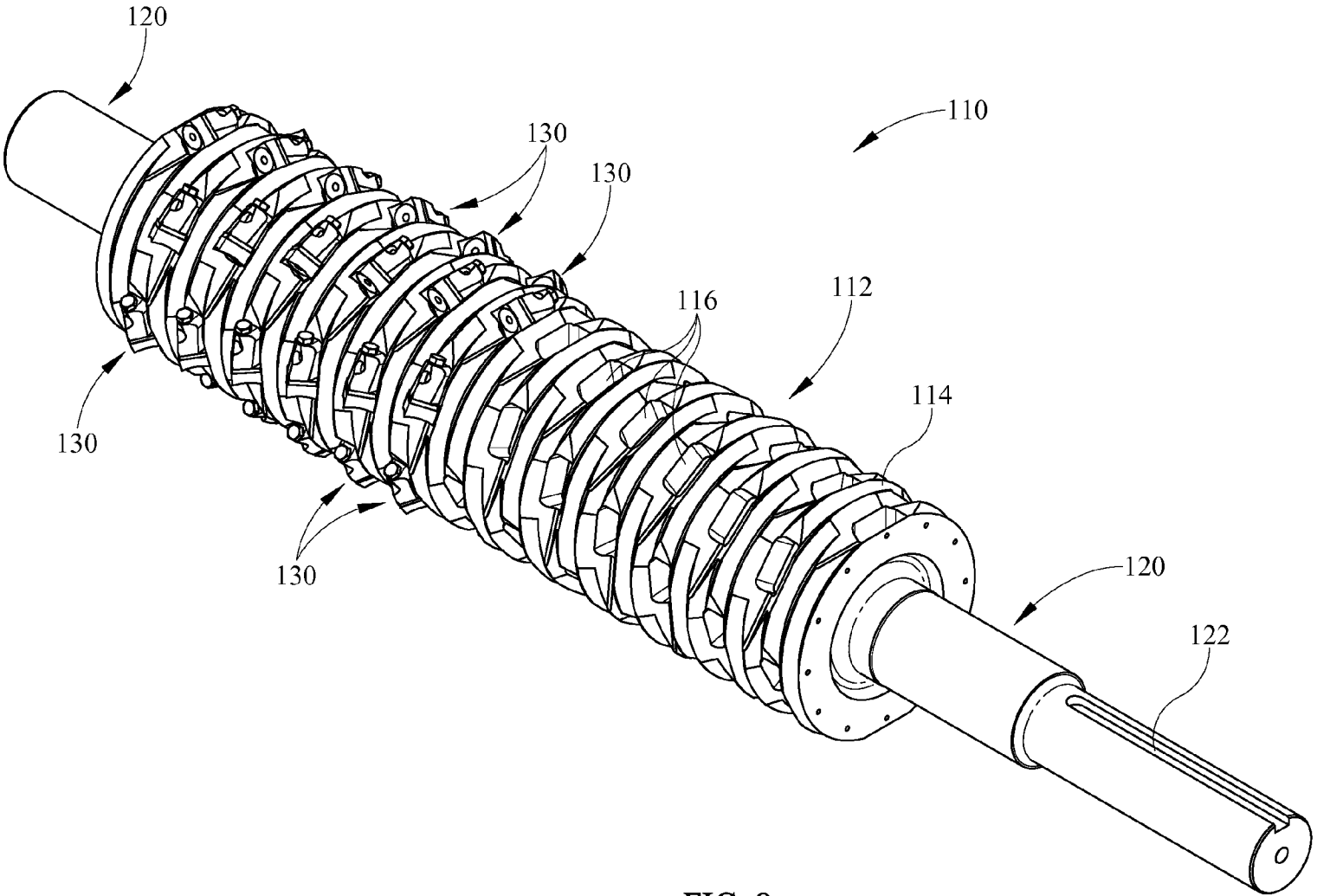
FIG. 8 depicts a perspective view of an alternative rotor assembly.

Referring now to FIG. 8, a perspective view of an alternative rotor assembly 110 is depicted. In comparison with the rotor assembly 10 of FIG. 1, the assembly 110 has a "corrugated" rotor surface 114. The corrugation may be formed by rounded crests and valleys or angled crests and valleys, as with the instant embodiment. The corrugation in welded prior art cutting tools provides a stronger bond between cutting tools and rotors than smooth surface rotors such as rotor 12. The rotor assembly 110 comprises a corrugated rotor 112 including the corrugated surface 114. Located within the corrugated portions of the rotor 112 are toolholder assemblies 130 each positioned in a pocket 116. The toolholder assemblies 130 are disposed in a preselected spacing and orientation. Each of the toolholder assemblies 130 is fastened to the rotor 112 as described further herein.

Within the corrugations 114 of the rotor 12 are pockets 116. These pockets are circumferentially offset a preselected arcuate distance from an immediately adjacent pocket 116. The pockets 116 of the present embodiment are also arranged in a chevron pattern, but spacing between toolholder assemblies of a single chevron is wider than the previous embodiment. Alternatively stated, the spacing of the toolholder assemblies 130 differs from the first embodiment in that one toolholder assembly 130 is offset a larger arcuate from a second toolholder which cuts immediately adjacent to the first assembly 130. This arrangement provides a more random presentation of cutters to the material being cut in the shredding process.

Figure 9:
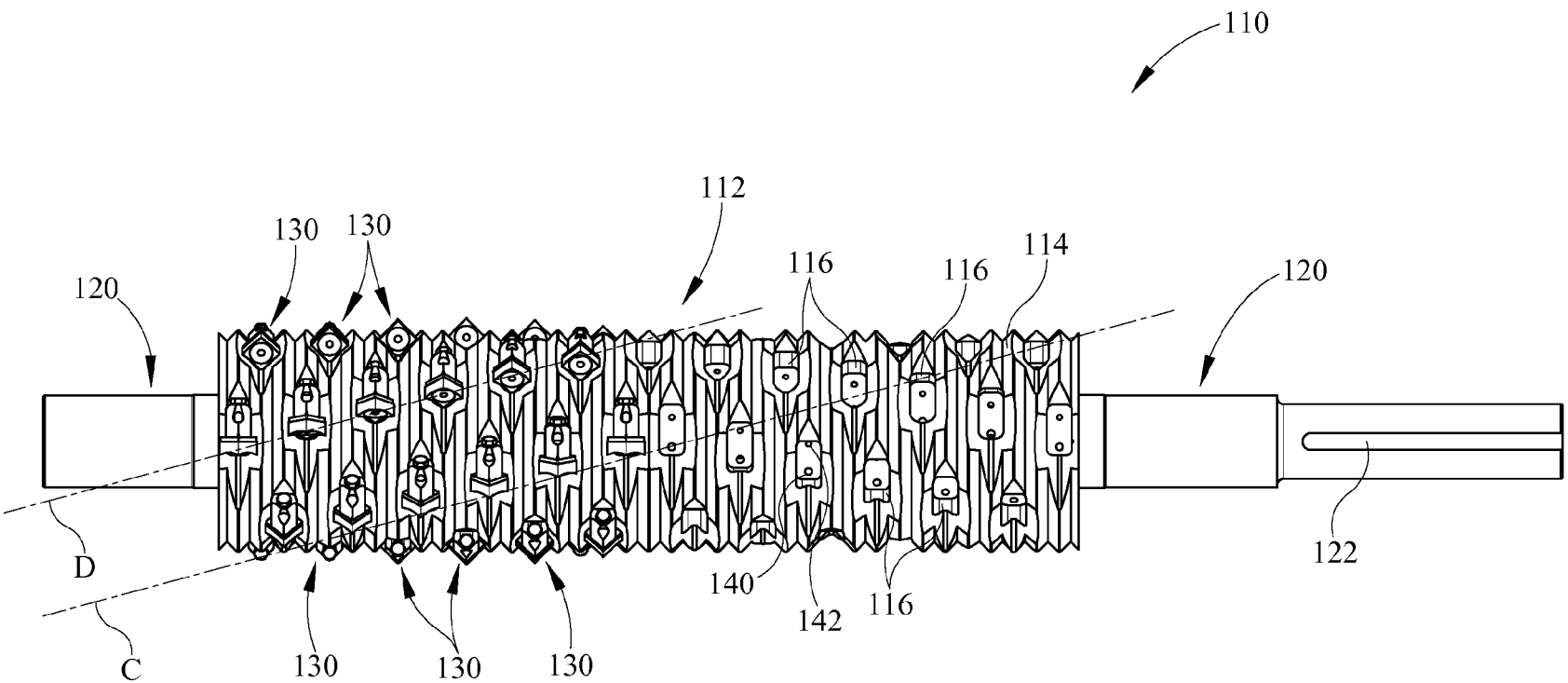
FIG. 9 depicts a front view of the rotor assembly of FIG. 8.

Referring now to FIG. 9, a front view of the rotor assembly 110 is depicted. In this view, the rotor assemblies 130 are disposed generally at an angle to the longitudinal axis of the rotor 112 and shaft 120 and defining the chevron shape. Additionally, a larger gap is seen between adjacent toolholder assemblies 130 along a diagonal cutting line. Offset an arcuate distance from the adjacent toolholder assemblies 130 of a single cutting line C are toolholders 130 of an adjacent cutting line D of toolholder assemblies which are spaced to fit within the gaps between the toolholder assemblies 130 of the first cutting line. This structure decreases the loading of the rotor assembly 110, motor and transmission.

As also shown in FIG. 9, the corrugations in surface 114 are formed by linear crests and valleys. Each of the cutting tools 134 are oriented so that a corner of a tool 134 extends downwardly into the corrugation of the rotor 112 as best seen along the upper edge of rotor 112. This allows existing corrugated rotors, which may have used welded toolholders, to be retrofit by machining pockets 116 and the bolt-in toolholder assemblies 130. As previously mentioned, the rotor 112 includes a plurality of pockets 116. Each of the pockets 116 includes a first fastening aperture 140 and a second fastening aperture 142.

Figure 10:
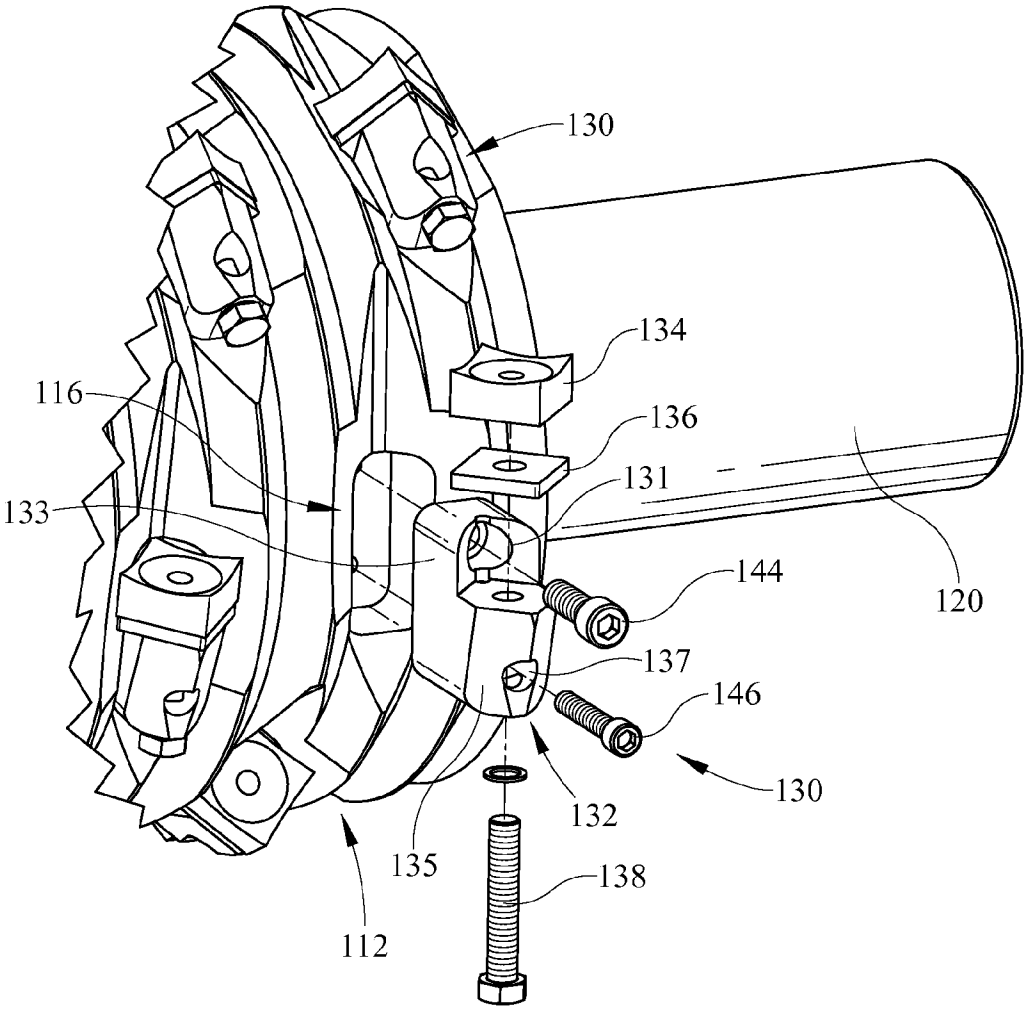
FIG. 10 depicts an exploded perspective view of the bolt-in holder.
Figure 11:
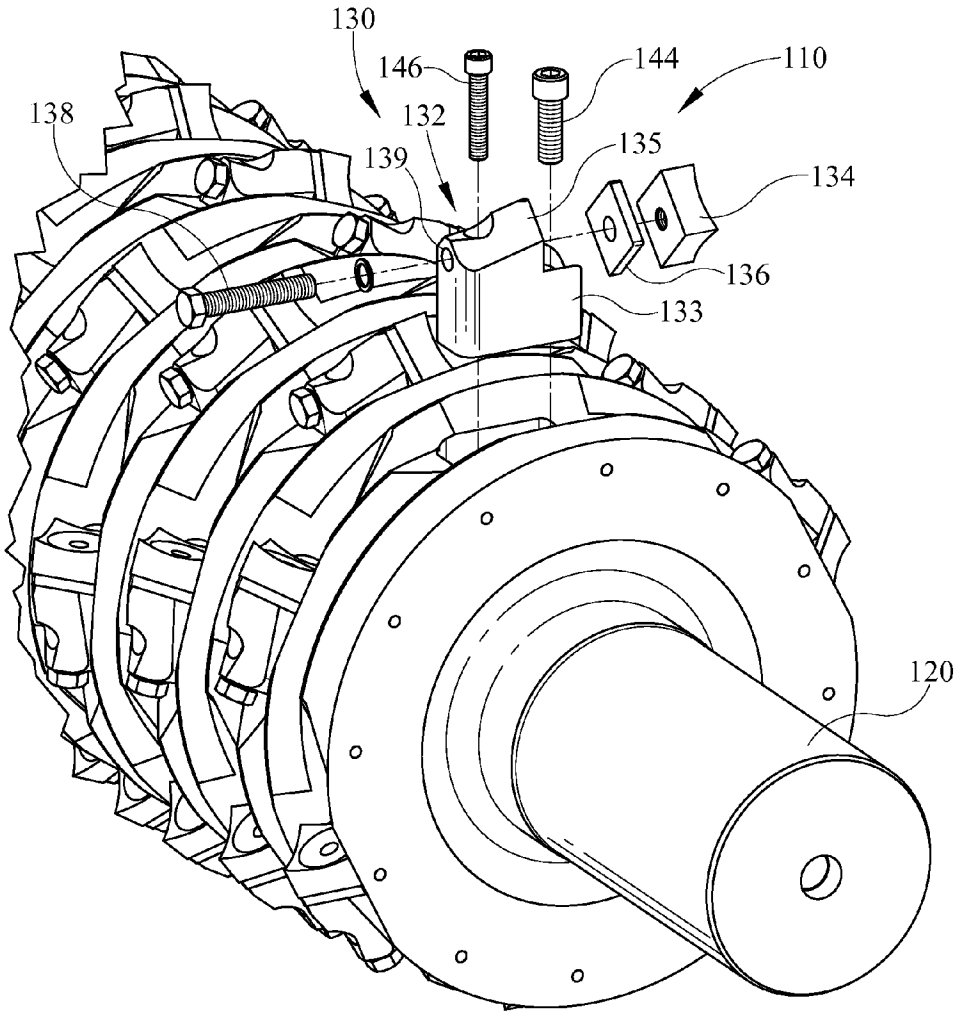
FIG. 11 depicts an alternative exploded perspective view of the bolt-in toolholder of FIG. 10.

Referring now to FIGS. 10 and 11, perspective views of a toolholder assembly 130 are depicted. The toolholder assembly 130 comprises a toolholder 132 which is sized and shaped to fit within the pocket 116. The toolholder 132 comprises a base 133 and a cutter mounting portion 135 extending from the base 133. Extending through the base 133 is a first fastening aperture 131. The aperture 131 extends radially downward toward the center of the rotor 112 and shaft 120. The surfaces through which the aperture 131 extends are not horizontal as with first embodiment but instead are angled to receive the tool 134. The cutter mounting portion 135 extends upwardly from the base 133 providing a surface against which an insert 136 and cutting tool 134 are positioned. Adjacent the first fastening aperture 135 are angled surfaces which receive two angled edges of each of the insert 136 and the cutting tool 134. It should be understood that despite the difference in numerals of the pockets 16,116, the pockets are substantially similar in size and shape so that either of the pockets 16,116 may fit either of the toolholders 32,132. In turn, one skilled in the art that the toolholder bases 33,133 are of the same size and correspond to either of the pocket 16,116. Accordingly, the pocket and toolholder arrangement may be considered universal so that pocket 16 may receive either toolholder 32,132. Similarly, pocket 116 may receive toolholder 32, 132. A user may therefore convert a rotor from a first cutting tool type, spacing, and pattern, to a second cutting tool type, spacing, and pattern depending on the type of cutting needed. Even further, the pocket and toolholder system of the instant disclosure allow for the possibility that pockets of a single rotor may receive both types of toolholders 32, 132 at the same time so as to define a hybrid cutting system.

Figure 12:
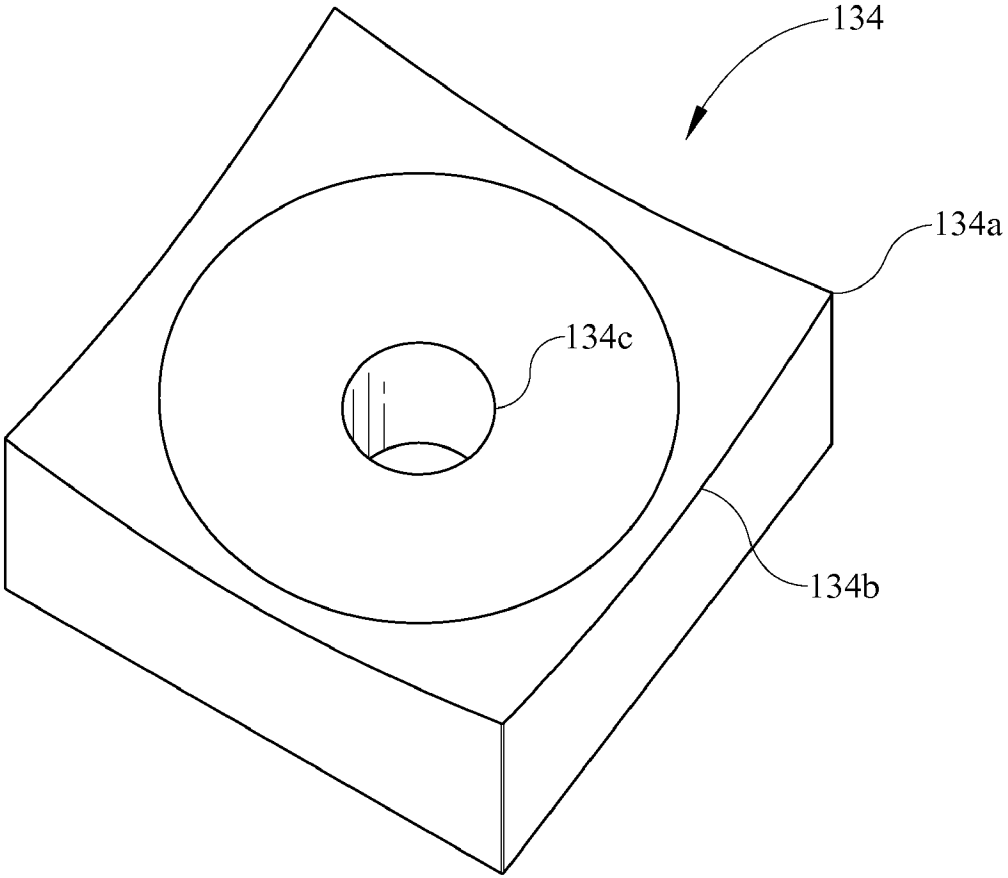
FIG. 12 depicts a perspective view of an alternative cutting tool.

As shown in the FIGS. 11 and 12 depicting the second embodiment, the cutting tool 134 is generally square in shape and is rotated forty-five (45) degrees so that one corner of the cutting tool 136 points downwardly into the base 133. The insert 136 may be formed of a polymeric or elastomeric material. Alternatively, the insert 136 may be formed of a steel or other hardened material to cushion the impact of the cutting tool with respect to the toolholder 132, and includes the radius or chamfer as previously described. The toolholder assembly 130 further comprises the first aperture 131 and a second aperture 137 extending downwardly through the cutting tool mounting portion 135. The first aperture 131 aligns with first aperture 140. The second fastening aperture 137 aligns with the second fastening aperture 142 in the rotor 112. A third fastening aperture 139 extends through the second fastening aperture 137 transversely through a mounting surface of a cutter mounting portion 135 so as to fasten the insert 136 and cutting tool 134 to the toolholder 132. As described with the first embodiment, the first and second apertures 131, 137 are circumferentially aligned allowing for a toolholder 132 which is more narrow than the cutting tool 134.

Referring now to FIG. 12, the cutting tool 134 is shown in perspective view. The cutting tool 134 is generally square in shape and has four curved forward edges. The curved edges result in the four corners being positioned slightly forward of the edges so that during the cutting process the corners 134*a* engage the material prior to the edges 134*b*. This "hawks' bill" design provides a very aggressive cut on the material being shredded and the spacing of the tools 134 are more randomized with respect to presentation to the material being shredded. The central portion of the cutting tool 134 includes an aperture for receiving a fastener. The aperture 134*c* allows fastening of the cutting tool 134 to the toolholder 132. The surface extending outward from the fastening aperture 134*c* to the edges 134*b* and corners 134*a* are concave which also aides in the cutting process.

Figure 13:
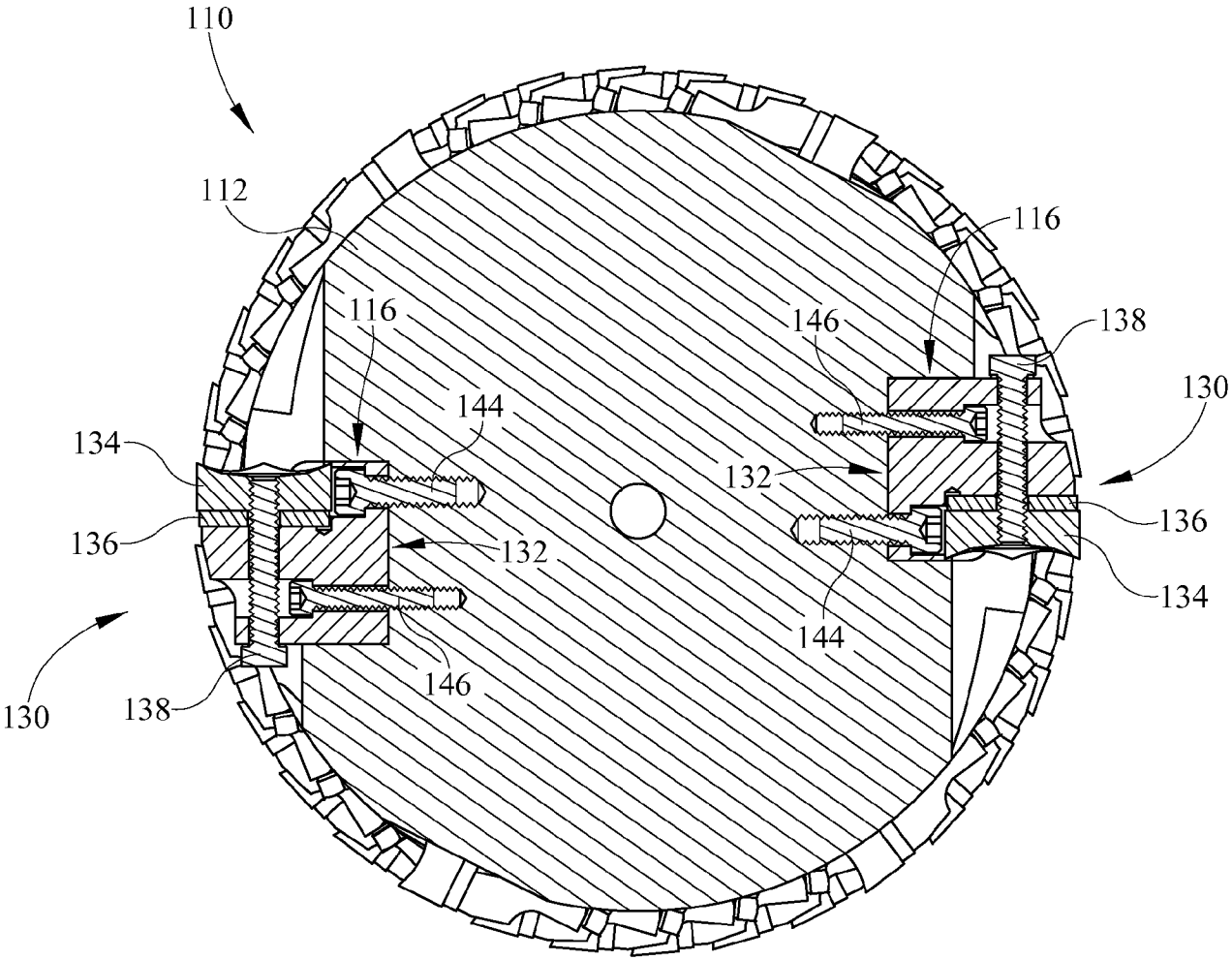
FIG. 13 depicts a side section view of the rotor assembly of FIG. 8.

Referring now to FIG. 13, a side section view of the rotor assembly 110 is depicted. The rotor 112 is sectioned depicting the toolholder assemblies 130. Each toolholder assembly includes the toolholder 132 and first and second circumferentially aligned fasteners 144 extending through the toolholders 132 and into the rotor 112. Each of the toolholders 132 is positioned in the machined pockets 116. The cutting tool 134 is shown positioned on the toolholder 132 and a third bolt 138 passes through the toolholder 132 and retains the insert 136 and cutting tool 134 thereon. The concave shape of the inner cutting tool surface, as well as the pointed corner design of the cutting tool, is also easily seen from this view.

Figure 14:
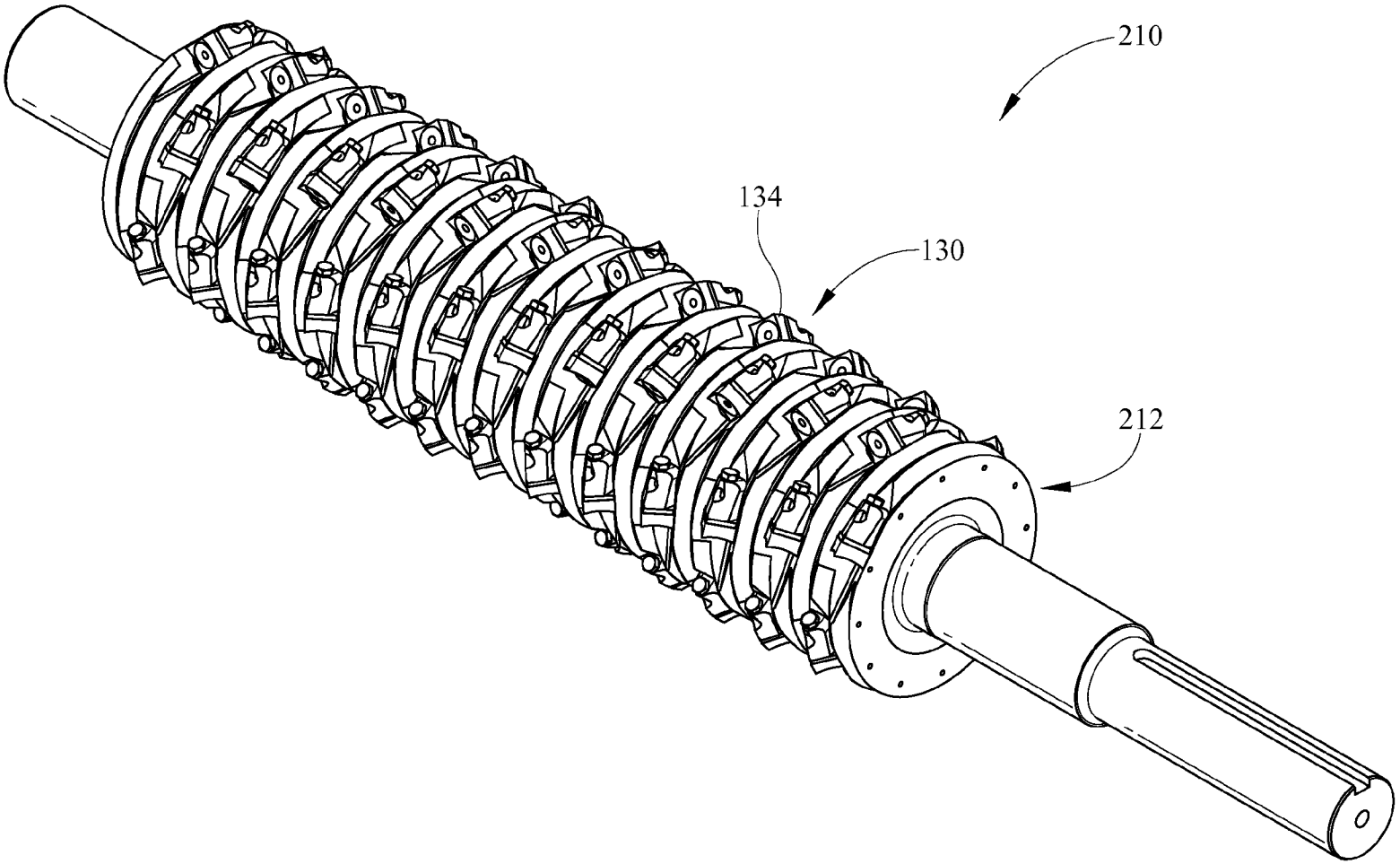
FIG. 14 depicts a perspective view of an alternative bolt-in toolholder having a spiral pattern.

Referring now to FIG. 14, an alternative rotor assembly 210 is depicted in perspective view. The rotor assembly 210 comprises a rotor 212 having a corrugated surface. The corrugated surface comprises a plurality of toolholder assemblies 130 including cutting tools 134. Each of the toolholder assemblies is arranged and disposed in a pocket. The pockets are arranged in a spiral pattern rather than the chevron pattern previously shown and described.

Figure 15:
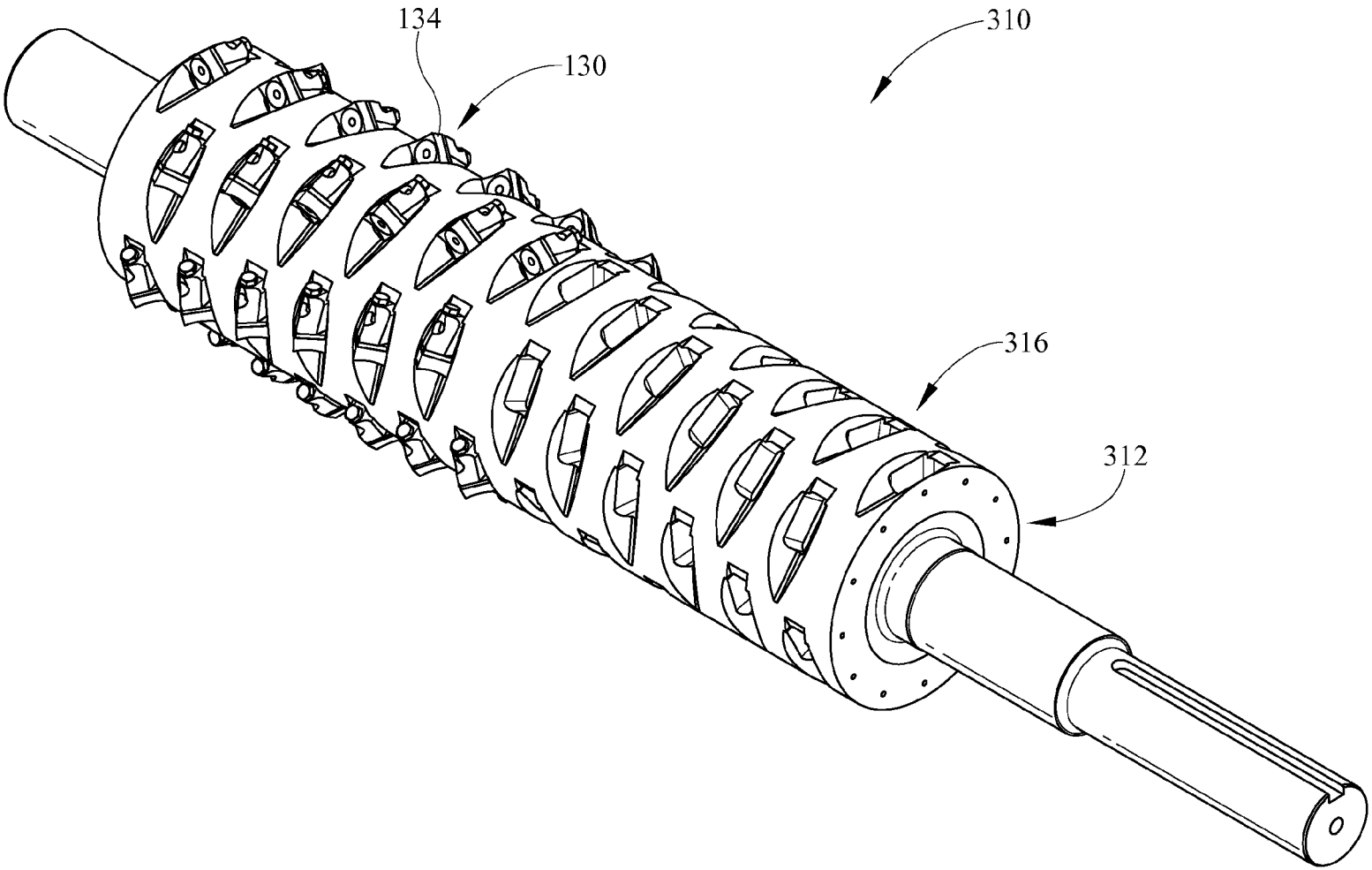
FIG. 15 depicts a smooth surface rotor having a chevron pocket pattern and the cutting tool of FIG. 12.

Referring to FIG. 15, a perspective view of an alternative rotor assembly 310 is depicted. A rotor 312 has a smooth surface and includes pockets 316. Each pocket 316 includes a toolholder assembly 130, including a cutting tool 134. The smooth surface rotor includes pockets 316 which are arranged in a chevron pattern according to the embodiment shown in FIG. 15.

Figure 16:
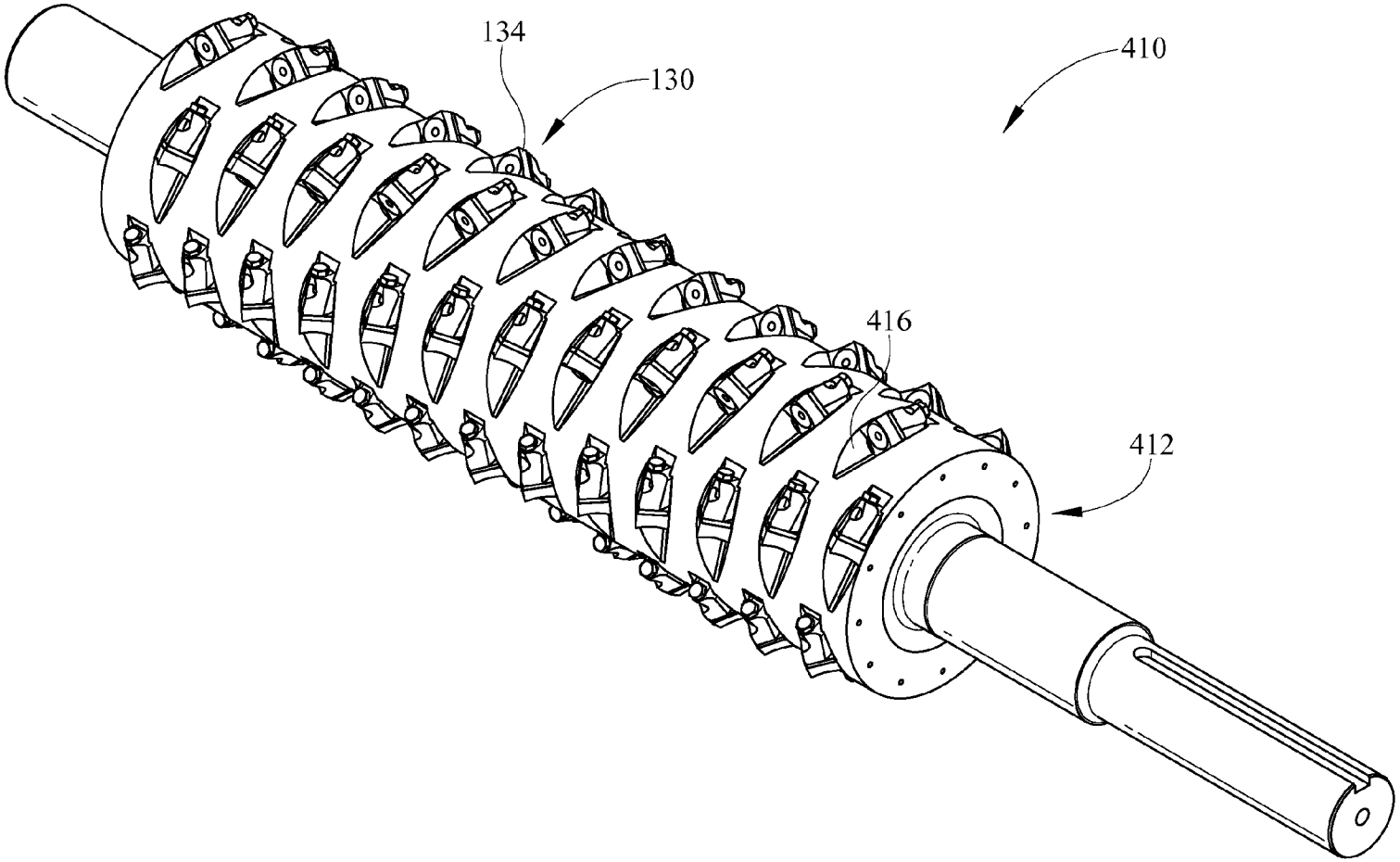
FIG. 16 depicts a smooth surface rotor having a spiral pocket pattern and which utilizes cutting tools of FIG. 12; and, FIG. 17 depicts a smooth surface rotor having a spiral pocket pattern which utilizes cutting tools depicted in FIG. 6.

Referring to FIG. 16, a perspective view of an alternate rotor assembly 410 is depicted. The assembly 410 includes a rotor 412 which has a smooth surface and a plurality of pockets 416. Each pocket 416 includes a toolholder assembly 130 including cutting tool 134. Each of the pockets 416 are arranged in a spiral pattern rather than a chevron pattern.

Figure 17:
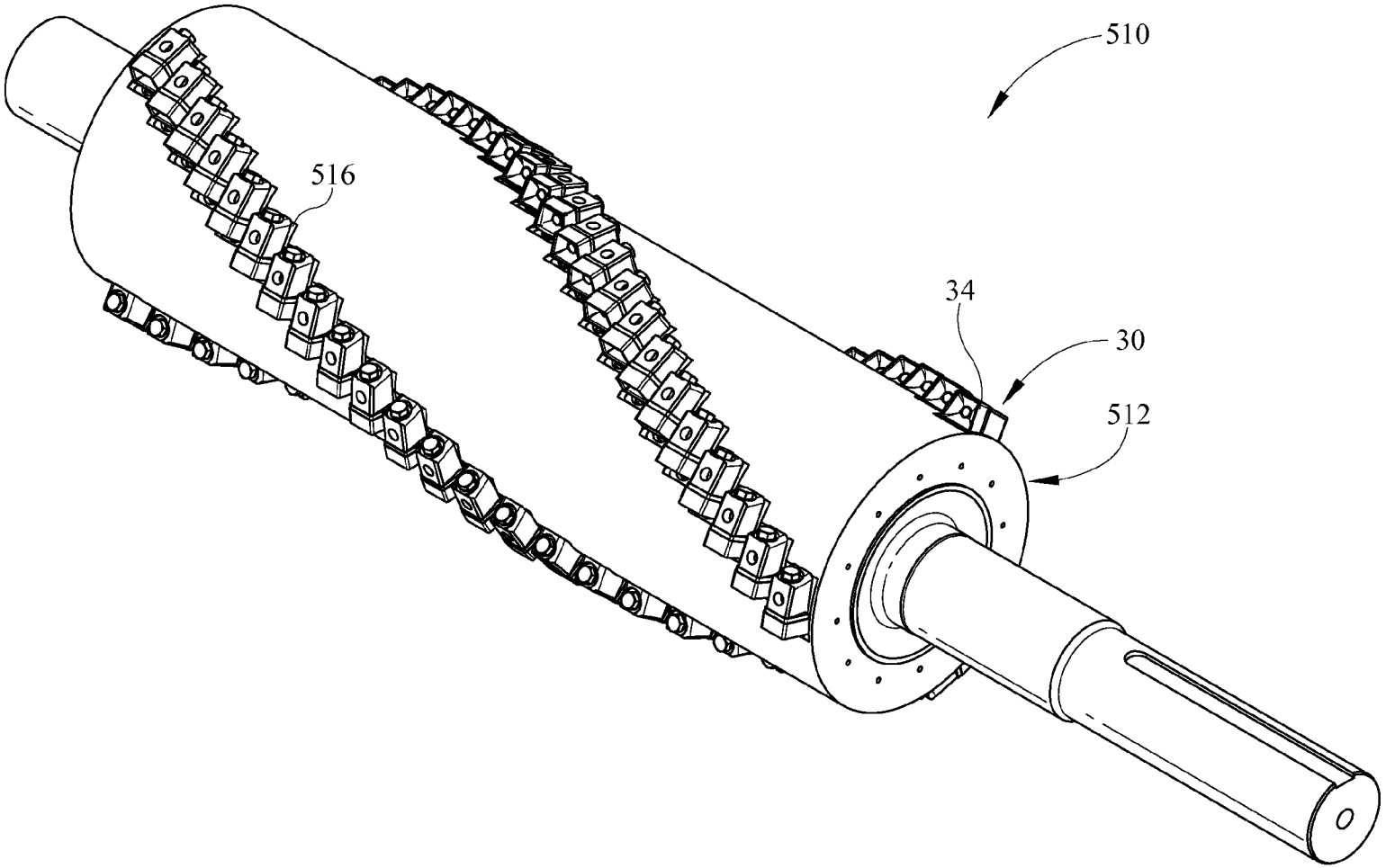

Referring to FIG. 17, an alternate rotor assembly 510 is depicted. The rotor assembly 510 includes a rotor 512 and a plurality of pockets 516 which are arranged in a spiral pattern. Each of the pockets 516 includes a toolholder assembly 30 including cutting tool 34. Thus, each of the toolholder assemblies 30, 130 may be utilized in either a chevron pattern or a spiral pattern, for example, and may be used in alternative patterns.

The foregoing description of several embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention and all equivalents be defined by the claims appended hereto.

The invention claimed is:

1. A bolt-in toolholder assembly for a shredding device, comprising:

a rotor having a substantially cylindrical shape;

a plurality of pockets formed in the rotor and spaced apart axially at preselected distances to form a preselected patterns;

a toolholder shaped to fit and be seated within said at least one of said plurality of pockets;

said toolholder comprising:

a base portion and a cutter mount;

said base having a first fastening aperture and receiving a first bolt for bolting said toolholder to said rotor;

said cutter mount having a second fastening aperture and receiving a second bolt for bolting said toolholder to said rotor, said first and second fastening apertures being circumferentially aligned and extending into said rotor generally perpendicular to an axis of said rotor;

a third bolt hole extending substantially transverse to said second fastening aperture and receiving a third bolt across said second fastening aperture and through said cutter mount; and, a cutting tool disposed against said cutter mount where said cutter mount extends upwardly from said base, said third bolt connecting said cutting tool to said cutter mount.

2. The bolt-in toolholder assembly of claim 1 further comprising one of a radius and a chamfer between said base and said cutter mount.

3. The bolt-in toolholder assembly of claim 2 further comprising an insert between said cutter mount and said cutting tool.

4. The bolt-in toolholder assembly of claim 3, said insert having one of a radiused and a chamfered edge substantially corresponding to said one of a radius and chamfer between said base and said cutter mount.

5. The bolt-in toolholder assembly of claim 1, said third bolt extending from said rear of said toolholder through said cutter mount.

6. The bolt-in toolholder assembly of claim 5, further comprising a machined portion in a rear surface of said toolholder for receiving a bolt head.

7. The bolt-in toolholder assembly of claim 1, said rotor having a substantially flat surface.

8. The bolt-in toolholder assembly of claim 7, said cutting tool being trapezoidal in shape.

9. The bolt-in toolholder assembly of claim 7, said cutting tool being substantially square in shape.

10. The bolt-in toolholder assembly of claim 1, said rotor having a substantially corrugated surface.

11. The bolt-in toolholder assembly of claim 10, said cutting tool being substantially square and having a corner extending into said corrugated surface.

12. The bolt-in toolholder assembly of claim 1, further comprising at least one cap for covering one of said bolt holes.

13. The bolt-in toolholder assembly of claim 1, said preselected pattern being chevron shaped.

14. The bolt-in toolholder assembly of claim 1, said preselected pattern being spiral shaped.

15. A bolt-in toolholder assembly for a shredding device, comprising:

a rotor having a substantially cylindrical shape;

a plurality of toolholders bolted to said rotor in a preselected pattern and spacing;

a plurality of pockets disposed along said rotor spaced apart axially;

said plurality of toolholders disposed in said plurality of pockets;

each of said plurality toolholders having a base and a tool mounting portion;

each of said plurality of toolholders having a first bolt extending through said base and a second bolt extending through said tool mounting portion, said first and second bolt holes receiving bolts generally radially extending into said rotor;

upper ends of said first and second bolts being aligned in a circumferential direction of said rotor;

a third bolt hole extending through said tool mounting portion and intersecting said second bolt hole;

a cutting tool positioned on said tool mounting portion, said cutting tool having an aperture aligned with said third bolt hole; and, a third bolt extending through said tool mounting portion and engaging said cutting tool.

16. The bolt-in toolholder assembly of claim 15, said preselected pattern being one of spiral or chevron shaped.

17. The bolt-in toolholder assembly of claim 15, further comprising an insert disposed between said cutting tool and said tool mounting portion of said toolholder.

18. The bolt-in toolholder assembly of claim 15, said first and second bolts aligned circumferentially to narrow a width of each of said plurality of toolholders.

19. The bolt-in toolholder assembly of claim 15, said width of each of said plurality of toolholders being less than a width of said cutting tool.

20. The bolt-in toolholder assembly of claim 15, said rotor being one of a substantially smooth surface and a corrugated surface.

21. The bolt-in toolholder assembly of claim 20, said cutting tool having one of a smooth surface and a corner extending into said corrugated surface.

22. The bolt-in toolholder assembly of claim 15, said third bolt extending in a direction of rotor rotation.

23. The bolt-in toolholder assembly of claim 15, further comprising caps for said first and second bolt holes.

24. A bolt-in toolholder assembly for shredding, comprising:

a rotor having a generally cylindrical shape;

a plurality of pockets disposed along a periphery of said rotor in a preselected pattern;

at least one of said pockets having a toolholder including:

a base disposed within said pocket and a cutting tool portion extending above an upper surface of said rotor;

a first bolt hole extending through said base and aligned with a fastener aperture in said rotor;

a second bolt hole extending through said cutting tool portion and circumferentially aligned with said first bolt hole;

a third bolt passing through a third bolt hole and engaging said cutting tool, said third bolt hole extending through said second bolt hole; and, a cutting tool fastened to said toolholder.

25. The bolt-in toolholder of claim 24, at least one of said plurality of pockets having a cap covering said pocket.

* * * * *